United States Patent [19]

Wilkerson

[11] 4,239,211

[45] Dec. 16, 1980

[54] PROCESS OF PRODUCING A WEIGHTED EXERCISING DEVICE

[76] Inventor: C. William Wilkerson, 7709 Audubon Dr., Raleigh, N.C. 27609

[21] Appl. No.: 951,504

[22] Filed: Oct. 16, 1978

[51] Int. Cl.[3] ..... A63B 21/12

[52] U.S. Cl. ..... 272/119; 272/143; 273/DIG. 30; 273/DIG. 5; 273/DIG. 19; 156/301

[58] Field of Search ..... 272/94, 119, 96, 67, 272/143; 264/239; 156/301, 280; 249/83; 273/73 R, DIG. 19

[56] References Cited

U.S. PATENT DOCUMENTS

| | | | |
|---|---|---|---|
| 1,729,209 | 9/1929 | Curtice | 272/96 X |
| 3,406,968 | 10/1968 | Mason | 272/96 X |
| 3,525,141 | 8/1970 | Smith | 272/96 |

*Primary Examiner*—Richard C. Pinkham
*Assistant Examiner*—William R. Browne
*Attorney, Agent, or Firm*—Mills & Coats

[57] ABSTRACT

In abstract a preferred embodiment of the present invention is a weighted device which is suitable for wearing about the body and appendages to build strength and for related purposes. The weighted devices of the present invention are preferably constructed of a plurality of elongated weights interconnected in spaced relation to each other and are encapsulated in a closed cell material with a soft vinyl coating which gives flexibility without bulging and eliminates bunching or shifting of the weights during violent exercises and movements.

5 Claims, 9 Drawing Figures

PROCESS OF PRODUCING A WEIGHTED EXERCISING DEVICE

FIELD OF INVENTION

This invention relates to exercise and aquatic devices and more particularly to weighted devices to be worn about the trunk and appendages of the body.

BACKGROUND OF INVENTION

In the past various types of exercise devices have been developed to build strength in the muscles of the body and to tone such muscles. In addition to such common methods as lifting weights and working out with tethered and spring biased exercise devices, weighted belts and head gear as well as ankle and wrist encircling devices have been devised. It is well recognized that the wearing of weights on the ankles and wrists as well as on the head and around the waist of the user will place a strain on the muscles thereby developing and toning the same. By far the preferred method of weighting these various and often complex devices have been through the use of lead shot which are relatively heavy in weight, will readily conform to the contours of the body and are relatively easy to incorporate into the finished manufactured product.

The big drawback in the use of lead shot for weighted exercise devices is that such shot tends to shift or bunch up thus becoming uncomfortable to the user and creating an unbalanced situation which, particularly when used in conjunction with athletic practice, can be not only annoying but on some occasions dangerous during violent maneuvers. Attempts to overcome this objectionable attribute of lead shot for weighted exercise devices have been compartmentalizing such shot. This has only met with limited success in that a plurality of small bunched up weights are encountered rather than one large massed weight. The bunching is still very uncomfortable and the problem of throwing the user off balance by the shifting of the shot has not been overcome.

In an attempt to overcome the shifting problem of shot weight, a plurality of pocket like openings have been provided with cylindrical shaped, slug-like weights being insertable therein. This to some extent eliminates the shifting problem of shot although the weights still tend to bunch up one adjacent the other during violent maneuvers and the uncomfortableness of wearing these prior art devices has been a distinct drawback.

None of the prior known devices have been able to overcome the shifting of the weights during use and particularly during violent motions nor has the lumpy construction of such devices been overcome to provide a comfortable and yet efficient weighted exercise device.

BRIEF DESCRIPTION OF INVENTION

After much research and study into the above-mentioned problems, the present invention has been developed to provide a weighted exercise device in the form of a band which can be made in a number of various sizes and which is heavy in weight for its volume, is comfortable to wear, and wherein the weights will not shift even as a result of violent exercise.

The above results are accomplished through the use of a plurality of elongated weights held in spaced relation to each other by a fabric like web material with a limited stretch coefficient encapsulated in a closed cell vinyl type material having a density similar to foam rubber. A strap is incorporated in one end of the device of the present invention and is adapted to retainingly cooperate with either a Velcro type material at the other end or a buckle securing means. To the touch, the device is soft and supple, will readily contour to body and appendage contours and can be worn for extended periods of time without discomfort or other adverse effects.

An object of the present invention is to provide a method of bonding a plurality of elongated weights in spaced relation to each other between two strips of relatively nonelastic web-like material, encapsulating the weights in a relatively soft material having a density approximating that of foam rubber, securing a fastening strap juxtaposed to said web and coating the product in a relatively soft, plyable material to provide a soft, flexible, nonweight-shifting exercise device.

DETAILED DESCRIPTION OF INVENTION

With further reference to the drawings, a preferred embodiment of the weighted exercise device of the present invention is indicated generally at 10 and is constructed in three phases. First a plurality of weights 11 are provided which can be cut from stock bar material and are generally elongated with side portions 12 being generally flat and edge portions 13 being rounded or arcuate in cross section. The purpose of this configuration will become more apparent as hereinafter described.

Figure 1:
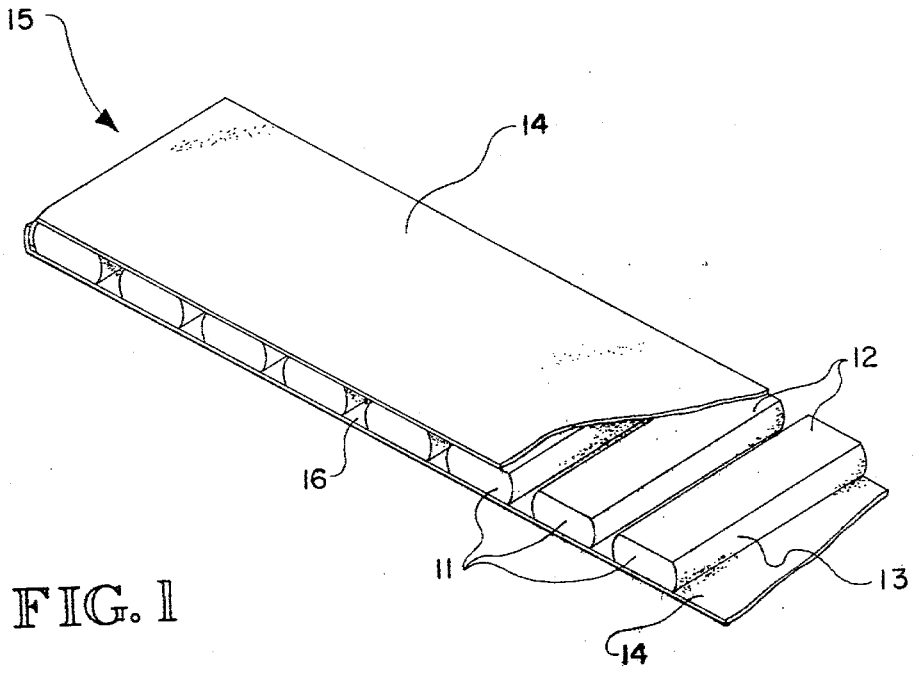
FIG. 1 is a cutaway perspective view of the weight retaining webs of the present invention.
Figure 2:
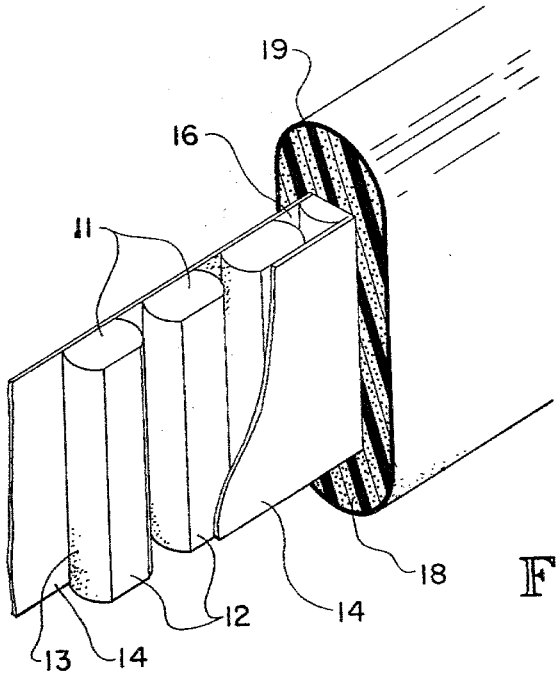
FIG. 2 is a cutaway perspective view showing the weighted webs encapsulated in the closed cell material.
Figure 3:
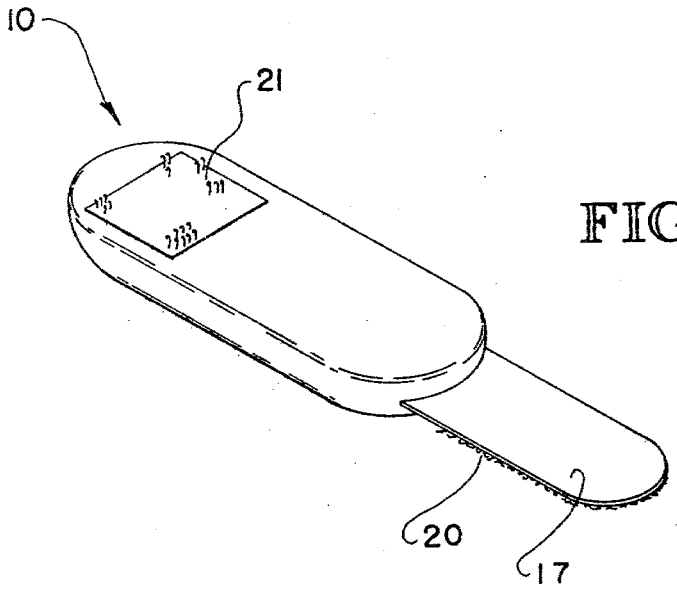
FIG. 3 is a perspective view of a weighted device manufactured in accordance with the present invention.
Figure 4:
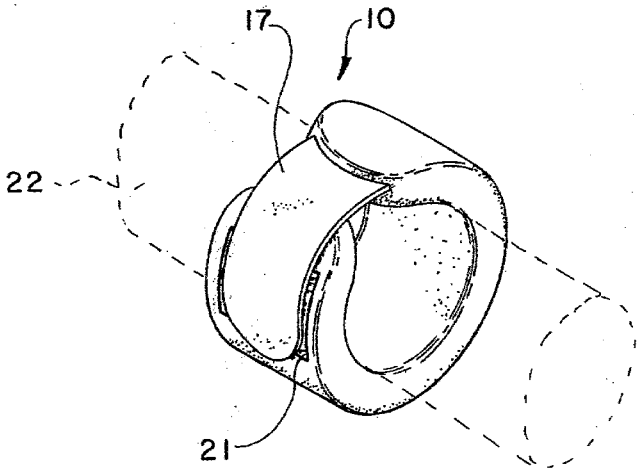
FIG. 4 is a perspective view of the device of FIG. 3 in use configuration about an appendage of the wearer thereof.
Figure 6:
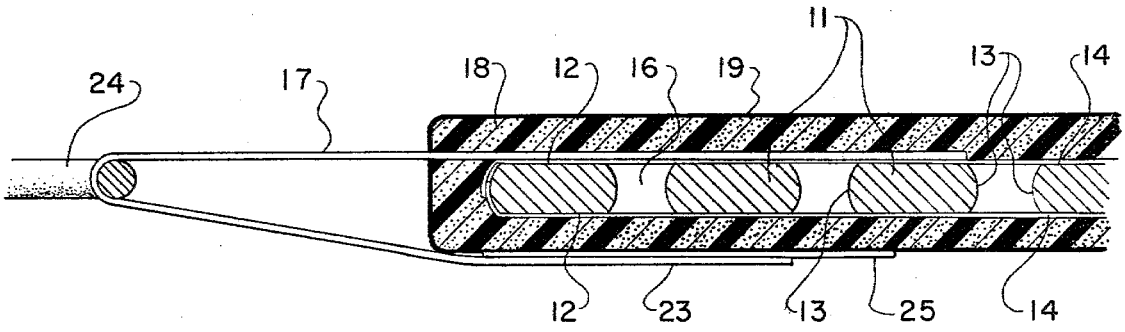
FIG. 6 is a sectional view taken through lines 6—6 of FIG. 5.

Each of the weights 11 is disposed generally parallel to each other as seen particularly clearly in FIGS. 1, 2 and 6.

A limited stretch webbing material, preferably of the fabric type, is indicated at 14 and is disposed on either side of weights 11 and is bonded to the flat sides 12 of each of such weights. This bonding of the webs 14 juxtaposed to each of the flat sides 12 of weights 11 can be of any suitable means such as impregnation with a glue-like substance. Weights 11 are spaced on the tape on one side and adhered thereto, then a second layer placed on the opposite side of each of the weights to form the weighted web shown in FIG. 1 and indicated generally at 15.

Regardless of the manner in which web 14 is adheringly or bondingly secured to weights 11, the finished configuration leaves an air space or pocket 16 between the weights. The purpose of this particular construction is to allow the exercise device of the present invention to bend not only at the pockets parallel to the longitudinal axis of the weights 11, but also to allow twisting to occur about the longitudinal axis of the overall device 10. In other words, the spaced weights and secured webbing provides a weighted web which can be rolled and twisted relative to its overall length.

Once the weighted web 15 has been constructed as described above, a securing tongue is glued or otherwise bonded to one end as seen particularly clear in FIG. 6. The entire weighted web 15 is then encapsulated within a relatively soft closed cell type material having a density of approximating that of foam rubber. Once the weighted web is encapsulated within the sponge like material 18, the entire exercise device 10, with the exception of securing tongue or strap 17, can be hot dipped in a vinyl to give a tough yet soft and plyable skin 19.

One side of strap 17 includes a fibrous loop material 20. Fixedly adhered to the skin 19 of the end of the exercise device opposite strap 17 is a material composed of a multiplicity of small resilient hook means 21. When the fibrous loop material 20 and the hook material 21 are placed juxtaposed to each other and pressed together, the hooks 21 become entangle in the fibrous loops 20 to form a relatively secure and yet releasable bond. This bond is relatively easily broken by peeling the layers apart, however, sliding movement between the surfaces is extremely difficult thereby providing in the present case a relatively simple securing means of great strength. Securing products of this general type are sold under the brand name Velcro which is commercially available.

Whenever the weighted exercise device of the present invention is desired to be used, it can simply be wrapped around the appendage 22 of the wearer thereof (whether the leg, ankle, head or the like) and surfaces 20 and 21 securingly pressed together to hold the device in proper position. Because the pocket spaces 16 allow relative movement between the weights 11 and because the curved or arcuate side portions 13 allow smooth contact between adjacent weights, coupled with the fact that the sponge like material 18 and the skin 19 are flexible, pliable and stretchable, a comfortable, contoured fit is accomplished.

Figure 5:
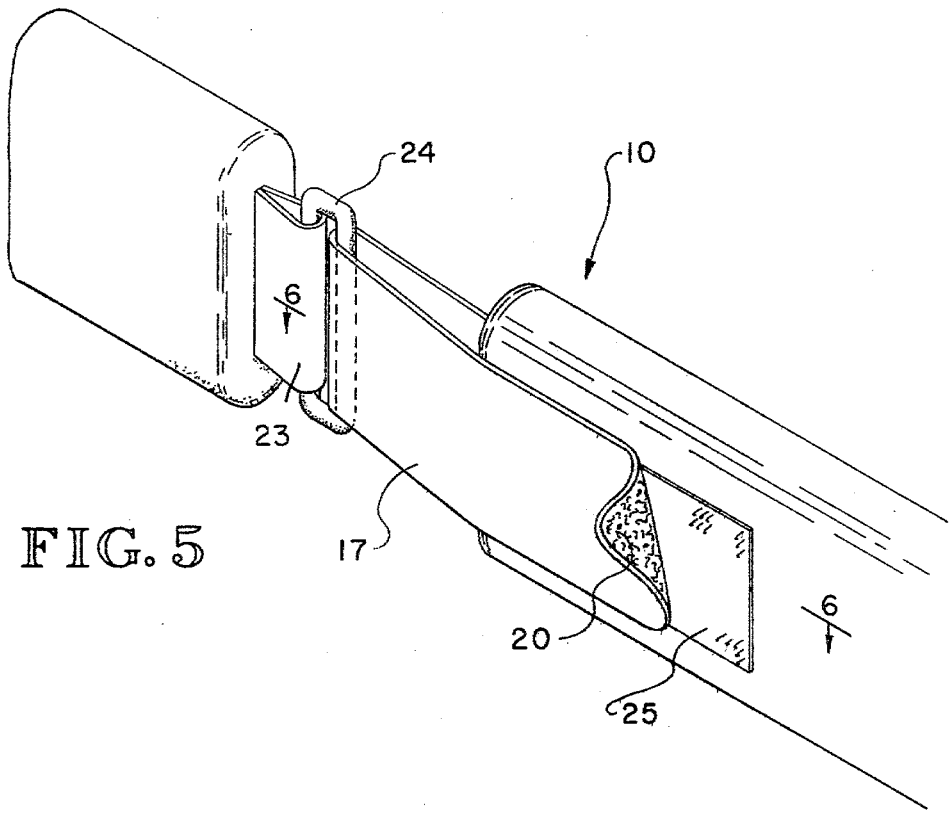
FIG. 5 is a modified securing means which is particularly useful when the present invention is used as a diving belt.

When added security is required in connecting the ends of the weighted exercise device of the present invention, a securing means such as that shown in FIG. 5 can be provided. In this case strap 17 is disposed at one end of the device in the normal manner described above. A buckle strap 23 is provided at the other end of the device and is embedded and structurally secured as described for strap 17.

To secure the ends of the modification shown in FIG. 5, strap 17 is passed through buckle 24 of strap 23, folded back parallel to itself, and is secured to the hook material as indicated at 25. Since strap 17 is looped back parallel to itself, the only tension on the connection shown in FIG. 5 is a sliding connection which, as indicated above, is extremely strong and can only reasonally be released by peeling the edge of the strap back. For purposes such as divers' belts, this is an extremely efficient securing means in a situation where accidental disconnection of the weight belt could be extremely serious if not disastrous to the user thereof.

Figure 7:
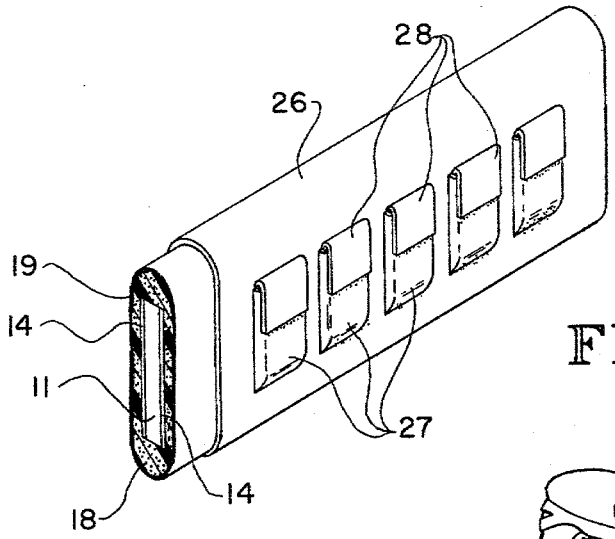
FIG. 7 is a cutaway perspective view of the present invention with a weight pocket sleeve disposed thereabout.
Figure 8:
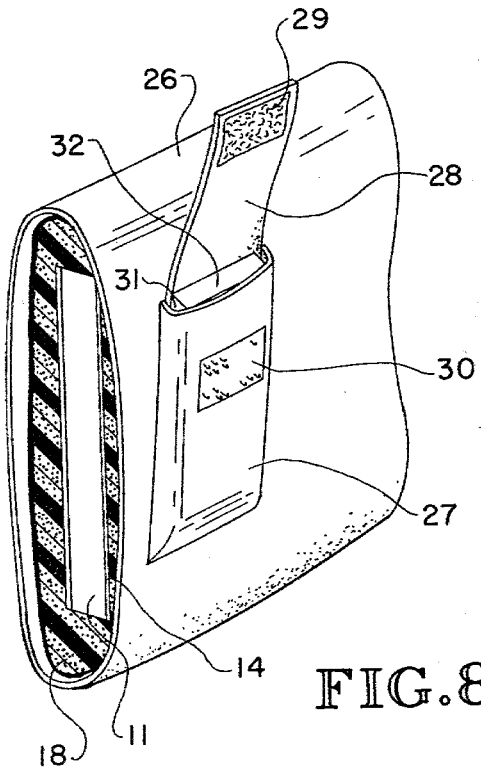
FIG. 8 is an enlarged perspective view of the weighted pocket sleeve of FIG. 7.
Figure 9:
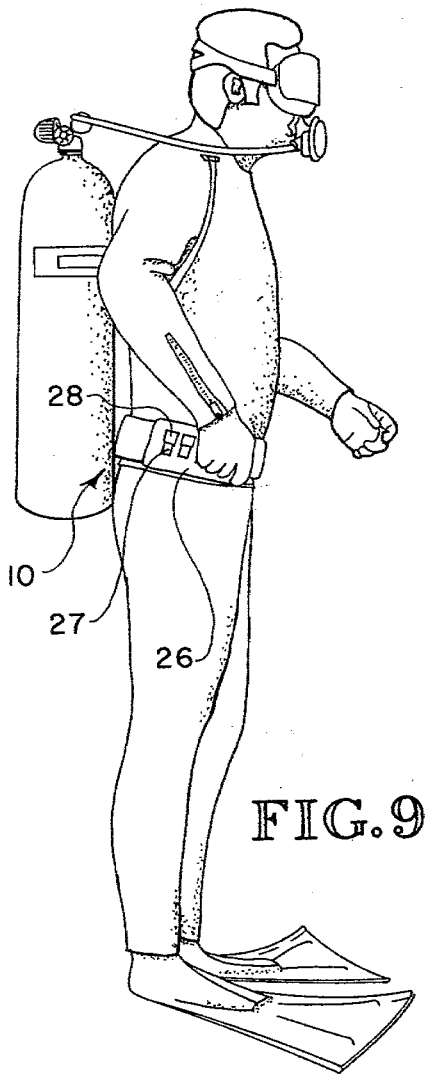
FIG. 9 is a perspective view of a diver using the device and its associated weight pocket sleeve as a diver's weight belt.

When it is desired to use the weighted device of the present invention as a diver's belt to counteract natural body buoyancy, a minimum weight belt for the purpose can be provided. Since different sized divers have different weight requirements to counteract body buoyancy, a weight sleeve such as that shown in FIG. 7 can be slipped over the weighted device 10. If the friction coefficient between the skin 19 and the interior of sleeve 26 is adequate, once in place relative movement therebetween will not occur unintentionally. This is advantageous in that the one thing that has been most undesirable in weighted diving belts in the past has been the shifting of the weights during use.

To add additional weight to the device, a plurality of pockets 27 are formed along the exterior of sleeve 26. Each of these pockets 27 has a flat closure 28 associated therewith. One surface of this flat closure includes a fibrous loop material 29 similar to that hereinabove described for material 20. On each of the pockets 27 is a relatively expansive patch of hook material 30 similar to that described for material 21. When the flaps 28 are opened, the interior 31 of the pockets 37 are exposed. Weights 32 can then be added as necessary and the flaps 28 folded over to engage hook and loop materials 29 and 30 to hold such flaps in closed condition.

Referring more specifically to the process of producing the weighted device of the present invention, a fabric or other suitable web type material 14 is laid on a flat surface. Weights 11 are then distributed in appropriate spaced relationship to each other on the web and through the use of a suitable adhesive are retainingly secured thereto. A second web 14 is then disposed on the opposite side of the weights and again is adhered thereto. The thus formed weighted web 15 is then dipped in a suitable glue type substance which form a permanent bond between the webbing and the weights.

Next a strap or tongue 17 is permanently bonded to the weighted web by means such as a suitable glue. The web is then inserted into a preformed sleeve of closed cell vinyl, rubber or neoprene as indicated at 18. The single open end of this sleeve has projecting therethrough strap 17 and once the weighted web is in proper position within the sleeve, such end can be permanently sealed with a suitable glue type bonding substance.

Once sealed, the entire weighted device is twice or double dipped in a liquid vinyl or neoprene to form the tough, yet soft, supple and plyable skin 19. Finally the patch of hook material 21 is bonded to the exterior of the device so that the same can be releasably secured to the loop material 20 of strap 17.

The final step in production of the weighted device of the present invention is to silk screen the product trade name, pertinent weight information, etc., on the exterior of skin 19.

For extra large weighted devices constructed in accordance with the present invention rather than inserting the weighted web in a preformed sleeve of closed cell material, a flat sheet of such material can be laid out and folded over the web with a permanent bond being formed through use of a suitable bonding agent such as the quick drying glue referred to above. The remainder of the device forming process would be completed as described above for the preformed sleeve version.

When the weighted device of the present invention is specifically designed for diving purposes, the air spacers or pockets 16 formed between the weights 11 and the adjacent webbing 14 should be filled. This can be accomplished in a number of ways but whatever filler is used should, of course, be compressable or distortable so that the flexibility of the device as hereinabove described will be maintained.

From the above, it is obvious that the present invention provides a weighted device which has a plurality of uses, whose weights will not shift even during violent exercises, and that is comfortable to the wearer thereof. The present invention also provides a weighted device which can be rolled and twisted and yet at all times provides an evenly distributed, nonshiftable weight balance.

The present invention may, of course, be carried out in other specific ways than those herein set forth without departing from the spirit and essential characteristics of the invention. The present embodiments are, therefore to be considered in all respects as illustrative and not restrictive and all changes coming within the meaning and equivalency range of the appended claims are intended to be embraced therein.

What is claimed is:

1. The process of producing a weighted device comprising: bonding a plurality of elongated weight means in spaced relationship to a web means to form a weighted web; bonding a strap means to one end of said weighted web; and permanently encapsulating said weighted web within a pliable, closed cell material whereby an improved weighted device is produced.

2. The process of claim 1 wherein said encapsulating closed cell material is exteriorly coated.

3. The process of claim 2 wherein said coating is accomplished by dipping in a liquid material.

4. The process of claim 3 wherein said coating material is a vinyl.

5. The process of claim 3 wherein said coating material is a neoprene.

* * * * *